US006076679A

United States Patent [19]

Yuhara et al.

[11] Patent Number: 6,076,679

[45] Date of Patent: Jun. 20, 2000

[54] GASTIGHT MAKEUP MATERIAL CONTAINER

[75] Inventors: Yukitomo Yuhara, Abiko; Yuji Ideshita, Yokohama, both of Japan

[73] Assignee: Yoshida Industry Co., Ltd., Tokyo, Japan

[21] Appl. No.: 09/254,092

[22] PCT Filed: Jul. 9, 1997

[86] PCT No.: PCT/JP97/02312

§ 371 Date: Mar. 1, 1999

§ 102(e) Date: Mar. 1, 1999

[87] PCT Pub. No.: WO99/01050

PCT Pub. Date: Jan. 14, 1999

[51] Int. Cl.[7] ..... A45D 33/00; B65D 69/00

[52] U.S. Cl. ..... 206/581; 206/823; 132/294; 132/300; 132/315; 220/23.89

[58] Field of Search ..... 206/235, 581, 206/823; 132/293, 294, 300, 301, 315; 220/23.91, 23.87, 23.89, 844

[56] References Cited

U.S. PATENT DOCUMENTS

| | | | |
|---|---|---|---|
| 1,626,613 | 5/1927 | Kendall et al. . | |
| 2,054,004 | 9/1936 | Sandberg et al. . | |
| 2,078,096 | 4/1937 | Parkin et al. . | |
| 2,137,886 | 11/1938 | Zell . | |
| 2,399,997 | 5/1946 | Flaster . | |
| 5,320,116 | 6/1994 | Ackermann | 206/581 |
| 5,353,818 | 10/1994 | Suzuki et al. . | |
| 5,353,947 | 10/1994 | Zinnbauer et al. | 206/581 |

FOREIGN PATENT DOCUMENTS

| | | |
|---|---|---|
| 58-40003 | 3/1983 | Japan . |
| 58-171616 | 11/1983 | Japan . |
| 63-28407 | 2/1988 | Japan . |
| 3-123411 | 12/1991 | Japan . |
| 7-11697 | 3/1995 | Japan . |
| 7-184717 | 7/1995 | Japan . |
| 8-347 | 1/1996 | Japan . |
| 8-348 | 1/1996 | Japan . |
| 8-38242 | 2/1996 | Japan . |
| 8-196337 | 8/1996 | Japan . |
| 9-37838 | 2/1997 | Japan . |
| 9-37839 | 2/1997 | Japan . |
| 9-47319 | 2/1997 | Japan . |
| 9-56452 | 3/1997 | Japan . |
| 9-65920 | 3/1997 | Japan . |
| 9-98828 | 4/1997 | Japan . |
| 9-98829 | 4/1997 | Japan . |
| 9-140442 | 6/1997 | Japan . |

*Primary Examiner*—Paul T. Sewell
*Assistant Examiner*—Luan K. Bui
*Attorney, Agent, or Firm*—Morrison & Foerster LLP

[57] ABSTRACT

This invention relates to a hermetically sealed cosmetic container which accommodates volatile cosmetic material in a refill case detachably installed in a container housing. The hermetically sealed cosmetic container has: a container housing (12) of a receptacular shape having a bottom wall (12*b*) and an outer peripheral wall (12*b*) which define an accommodating space (18) therein; an outer lid (16) for opening and closing the accommodating space; a refill case (20) having an inner tray (28) with a cosmetic accommodating region (28*a*), an inner lid (30) for opening and closing the cosmetic accommodating region, a hinge mechanism (32) projecting outwardly from the inner tray for rotatably mounting the inner lid to the inner tray, and a hermetic sealing mechanism (38,40) disposed between the inner tray and the inner lid for hermetically sealing the cosmetic accommodating region, the refill case being detachably installed in one side (18*a*) of the cosmetic accommodating region, leaving a space (18*b*) in the other side; a groove (12*d*) defined in the outer peripheral wall portion of the container housing for fitting the hinge mechanism; a pair of slide guides (46) disposed horizontally on a pair of parallel side walls (18*c*, 18*d*) of the outer peripheral wall portion of the container housing; and a pair of slides (48) disposed in the inner tray of the refill case for being guided by the slide guides to slide the refill case in the accommodating space.

5 Claims, 12 Drawing Sheets

GASTIGHT MAKEUP MATERIAL CONTAINER

TECHNICAL FIELD

The present invention relates to a hermetically sealed cosmetic container for containing cosmetic material in a portable fashion, and more particularly, to a hermetically sealed cosmetic container having a refill case detachably housed in a container housing, the refill case accommodating volatile cosmetic material therein.

BACKGROUND ART

Generally, cosmetic containers are used to carry cosmetic materials. Such a cosmetic container has a container housing accommodating cosmetic material therein, and an outer lid openably and closably hinged to a rear end of the container housing for covering the entire upper side of the container housing. The cosmetic container has a general structure which includes a hook mechanism disposed between the front ends of the container housing and the outer lid for keeping the outer lid closed, and a button projecting from the front end of the container housing for releasing the hook mechanism.

If the cosmetic material is a volatile cosmetic material, then the hermetic seal of the cosmetic container becomes important. There have been proposed various hermetically-sealed cosmetic containers which provide an increased hermetic sealing capability between the container housing accommodating cosmetic material therein and the outer lid for opening and closing the container housing. (See i) Japanese Laid-open Patent Publication No. 9-37839.) Some hermetically sealed cosmetic containers include an inner lid positioned between the container housing and the outer lid to provide a sealing structure between the inner lid and the container housing. (See ii) Japanese Laid-open Patent Publication No. 8-347 and iii) Japanese Laid-open Patent Publication No. 9-37838.) Recent years have seen a cartridge-type refill case detachably housed in a container housing and accommodating volatile cosmetic material therein. (See iv) Japanese Laid-open Patent Publication No. 9-65920 and v) Japanese Laid-open Patent Publication No. 9-98829.)

Specifically, the refill case comprises an inner lid openably and closably attached to the inner tray accommodating cosmetic material therein. An elaborate sealing mechanism is disposed between the inner tray and the inner lid and an elaborate detachable attaching mechanism is used between the refill case and the container housing. There is known a detachable attaching mechanism which allows an inner tray accommodating a non-volatile cosmetic material to be detachably housed in a container housing without use of an inner lid. (See vi) Japanese Laid-open Patent Publication No. 9-47319.) In a design having an inner lid disposed between the container housing and the outer lid, an elaborate mechanism is employed to open and close both lids because the outer and inner lids provide a double lid mechanism. (See vii) Japanese Laid-open Patent Publication No. 8-348 and viii) Japanese Laid-open Patent Publication No. 9-98828.)

The hermetically sealed cosmetic container shown in i) Japanese Laid-open Patent Publication No. 9-37839 includes an annular elastic gasket disposed below the outer periphery of an opening of a cosmetic accommodating region of the container housing, and an annular ridge projecting on an inner surface of the lid. When the lid is closed, the annular ridge and the annular elastic gasket are pressed against each other below the opening of the cosmetic accommodating region. The hermetically sealed cosmetic container disclosed in ii) Japanese Laid-open Patent Publication No. 8-347 has an annular elastic gasket of U-shaped cross section which is installed from above onto a peripheral edge of an opening of an inner tray and an elastic gasket disposed on the lid. When the lid is closed, the annular elastic gasket on the inner tray and the elastic gasket on the lid are pressed against each other. The hermetically sealed cosmetic container with the inner lid shown in iii) Japanese Laid-open Patent Publication No. 9-37838 includes an annular elastic gasket disposed below the outer periphery of an opening of a cosmetic accommodating region of the container housing and an annular ridge projecting on an inner surface of the inner lid, as is the case with Publication i), the annular ridge and the annular elastic gasket being pressed against each other below the opening of the cosmetic accommodating region.

The cosmetic container with the refill case disclosed in iv) Japanese Laid-open Patent Publication No. 9-65920 has the container housing divided into two portions, one as an accommodating region in which the refill case is detachably disposed, and the other as an accommodating region for cosmetic instruments. The accommodating region for detachable attachment and the cosmetic instrument accommodating region are divided by a partition wall having a recess defined in the central portion thereof, and a finger hook overhanging the inner lid is disposed in the recess and projects in the accommodating region for the cosmetic instruments. The cosmetic container with the refill case disclosed in v) Japanese Laid-open Patent Publication No. 9-98829 has a partition wall by which the container housing is divided into two portions as is the case with Publication iv). The partition wall and an outer peripheral wall of the container housing which is confronted by the partition wall have first engaging portions on their confronting surfaces, and the refill case has second engaging portions on side surfaces thereof for disengageably engaging the first engaging portions. The refill case is fixed in position by engagement of these first and second engaging portions.

The cosmetic container with the inner tray shown in vi) Japanese Laid-open Patent Publication No. 9-47319 has a partition wall by which the container housing is divided, one portion as an inner tray accommodating region. The inner tray has an engaging groove defined in the outer periphery thereof, and the partition wall has a first engaging tooth, which is engageable in the engaging groove, disposed on its inner surface on the side of the inner tray accommodating region. The inner surface of the inner tray accommodating region which opposes the partition wall has vertical slits extending longitudinally on both sides, defining a plurality of claws with free lower ends. The claws have second engaging teeth on the inner surface of the lower ends thereof for engagement in the engaging groove. The inner surface of the container housing between the claws serves as a holding wall having a free lower end, and the inner tray is pressed toward the first engaging tooth by a convexity on the holding wall.

The hermetically sealed cosmetic container with the inner lid shown in vii) Japanese Laid-open Patent Publication No. 8-348 has an opening member for pushing-open the inner lid, the opening member being disposed on either one of the openable and closable end of the inner lid or the container housing. The cosmetic container with the inner lid disclosed in viii) Japanese Laid-open Patent Publication No. 9-98828 has a single push-piece mounted on the container housing, the push-piece having a first releasing member for releasing a first hook with which the outer lid detachably engages the container housing, and a second releasing member for releasing a second hook with which the inner lid detachably engages the container housing. The first and second hooks can respectively be released with a single sliding action of the push-piece.

However, with the conventional hermetically sealed cosmetic containers disclosed in i) Japanese Laid-open Patent Publication No. 9-37839 and iii) Japanese Laid-open Patent Publication No. 9-37838, since the annular elastic gasket is disposed below the outer periphery of the opening of the cosmetic accommodating region of the container housing, it is necessary to define an annular recess in the outer periphery of the opening for receiving the annular elastic gasket, and hence to provide a space in which the annular recess is defined. If the container housing is to be of a certain size, then the opening is necessarily of a reduced diameter, reducing the volume of the cosmetic accommodating region, and hence, reducing the amount of the cosmetic material accommodated therein. With the hermetically sealed cosmetic container disclosed in ii) Japanese Laid-open Patent Publication No. 8-347, the elastic gaskets are disposed on both the inner tray and the lid, and are separately formed from the inner tray and the lid. Consequently, the disclosed container is made up of an increased number of parts which further complicates the structure, and cannot efficiently be assembled.

The inner lid of the cosmetic container revealed in iv) Japanese Laid-open Patent Publication No. 9-65920 can easily be opened by lifting the finger hook from the cosmetic instrument accommodating region since the finger hook of the inner lid is disposed in the recess in the partition wall. However, because the outer and inner lids are opened and closed by respective separate actions, the process of opening the lids is complex. The cosmetic container disclosed in v) Japanese Laid-open Patent Publication No. 9-98829 has the partition wall as is the case with Publication iv). The first engaging portions are disposed respectively on the partition wall and the outer peripheral wall of the container housing, and the second engaging portions are disposed on the side surfaces of the inner tray to detachably engage the first engaging portions. The presence of the partition wall complicates the mold structure used to mold the container housing. Also, since the first engaging portions are disposed on the partition wall, the structure is further complex. The cosmetic container shown in vi) Japanese Laid-open Patent Publication No. 9-47319 has the partition wall and the first and second engaging teeth. Since the second engaging teeth are disposed on the slitted claws, the structure is further complex.

With the hermetically sealed cosmetic container shown in vii) Japanese Laid-open Patent Publication No. 8-348, the opening member for pushing open the inner lid permits the inner lid to be easily opened. However, the need for opening the outer lid and the inner lid separately makes it inefficient to open the lids. The cosmetic container revealed in viii) Japanese Laid-open Patent Publication No. 9-98828 can easily be operated because the outer and inner lids can simultaneously be opened by a single sliding action of the push-piece with the first and second releasing members on the push-piece. It is, however, necessary to provide a space to slide the push-piece, resulting in various problems such as a corresponding increase in the size of the cosmetic container and reduction in the amount of the cosmetic material that can be accommodated therein.

DISCLOSURE OF INVENTION

In view of the conventional problems, it is an object of the present invention to provide a hermetically sealed cosmetic container having a region, simplified in structure, for accommodating a refill case in a container housing. Another object of the present invention is to provide a hermetically sealed cosmetic container which is capable of increasing the amount of cosmetic material to be accommodated therein without increasing the size of the cosmetic container, and reducing the space required to operate lids of a double structure while improving the efficiency with which to open the lids, without departing from the above object.

To achieve the above object, there is provided in accordance with the present invention a hermetically sealed cosmetic container comprising:

a container housing having a bottom wall and an outer peripheral wall surrounding the bottom wall, the outer peripheral wall and the bottom wall defining an accommodating space therein;

an outer lid rotatably mounted on the container housing for opening and closing the accommodating space;

a refill case having an inner tray defining a cosmetic accommodating region for accommodating cosmetic material therein, an inner lid for opening and closing the cosmetic accommodating region, a hinge mechanism projecting outwardly from the inner tray for rotatably mounting the inner lid to the inner tray, and a hermetic sealing mechanism disposed between the inner tray and the inner lid for surrounding and hermetically sealing the cosmetic accommodating region, the refill case being detachably installed in one side of the cosmetic accommodating region, leaving a space in the other side of the cosmetic accommodating region, with the hinge mechanism being disposed adjacent to the outer peripheral wall of the container housing, and the inner lid having an openable and closable end positioned on the opposite side of the hinge mechanism and within the accommodating space;

a groove defined in the outer peripheral wall portion of the container housing adjacent to the hinge mechanism, the hinge mechanism being fitted in the groove so as to be exposed out of the container housing;

a pair of slide guides disposed horizontally on a pair of parallel side walls of the outer peripheral wall portion of the container housing, the outer peripheral wall portion with the groove defined therein being interposed between the slide guides; and a pair of slides disposed in the inner tray of the refill case for disengageably engaging with the pair of slide guides, respectively, being guided by the slide guides to slide the refill case horizontally from one side of the accommodating space to the other;

the hermetic sealing mechanism comprising:

an annular ridge disposed on either one of the inner tray or the inner lid in surrounding relationship to the cosmetic accommodating region, and projecting toward the other; and a hermetically sealing ring disposed on the other of the inner tray and the inner lid and having a slanted surface movable in frictional contact with the annular ridge while the inner lid is being closed, the hermetically sealing ring being hermetically pressable against the entire periphery of the annular ridge.

A hermetically sealed cosmetic container further comprises a lid opening mechanism including:

a first engaging tooth disposed on the container housing;

a first hook disposed on the outer lid for disengageably engaging the first engaging tooth to keep the outer lid closed;

a second engaging tooth disposed on the inner tray of the refill case;

a second hook disposed on the inner lid of the refill tray for disengageably engaging the second engaging tooth to keep the inner lid closed; and a single push-piece rotatably mounted on the container housing for releasing the first hook and the first engaging tooth out of engagement and also releasing the second hook and the second engaging tooth out of engagement;

the push-piece comprising:

a single operating member for imparting operating forces to rotate the push-piece; and a first releasing member for releasing the first hook from the first engaging tooth and a second releasing member for releasing the second hook from the second engaging tooth, under the operating forces imparted to the operating member.

A hermetically sealed cosmetic container further comprises a lock mechanism disposed between the inner tray of the refill case and the pair of side walls of the container housing and being disengageably engaged for locking the refill case installed in one side of the accommodating space against sliding movement.

Further, there is provided a hermetically sealed cosmetic container wherein the pair of slide guides and the pair of slides are vertically disengageably engageable with each other for installing the refill case into and removing the refill case from the accommodating space in the container housing in the vertical directions.

Furthermore, a hermetically sealed cosmetic container according to the present invention comprises:

a container housing having a bottom wall and an outer peripheral wall surrounding the bottom wall, the outer peripheral wall and the bottom wall defining an accommodating space therein;

an outer lid rotatably mounted on the container housing for opening and closing the accommodating space;

a refill case having an inner tray defining a cosmetic accommodating region for accommodating cosmetic material therein, an inner lid for opening and closing the cosmetic accommodating region, a hinge mechanism projecting outwardly from the inner tray for rotatably mounting the inner lid to the inner tray, and a hermetic sealing mechanism disposed between the inner tray and the inner lid for surrounding and hermetically sealing the cosmetic accommodating region, the refill case being detachably installed in one side of the cosmetic accommodating region, leaving a space in the other side of the cosmetic accommodating region, with the hinge mechanism being disposed adjacent to the outer peripheral wall of the container housing, and the inner lid having an openable and closable end positioned on the opposite side of the hinge mechanism and within the accommodating space;

a groove defined in the outer peripheral wall portion of the container housing adjacent to the hinge mechanism, the hinge mechanism being fitted in the groove so as to be exposed out of the container housing;

a pair of slide guides disposed horizontally on a pair of parallel side walls of the outer peripheral wall portion of the container housing, the outer peripheral wall portion with the groove defined therein being interposed between the slide guides; and a pair of slides disposed in the inner tray of the refill case for disengageably engaging with the pair of slide guides, respectively, being guided by the slide guides to slide the refill case horizontally from one side of the accommodating space to the other;

a lock mechanism disposed between the inner tray of the refill case and the pair of side walls of the container housing and being disengageably engaged for locking the refill case installed in one side of the accommodating space against sliding movement; and a lid opening mechanism including: a first engaging tooth disposed on the container housing; a first hook disposed on the outer lid for disengageably engaging the first engaging tooth to keep the outer lid closed; a second engaging tooth disposed on the inner tray of the refill case; a second hook disposed on the inner lid of the refill tray for disengageably engaging the second engaging tooth to keep the inner lid closed; and a single push-piece rotatably mounted on the container housing for releasing the first hook and the first engaging tooth out of engagement and also releasing the second hook and the second engaging tooth out of engagement; the push-piece comprising: a single operating member for imparting operating forces to rotate the push-piece; and a first releasing member for releasing the first hook from the first engaging tooth and a second releasing member for releasing the second hook from the second engaging tooth, under the operating forces imparted to the operating member;

the hermetic sealing mechanism comprising:

an annular ridge disposed on either one of the inner tray or the inner lid in surrounding relationship to the cosmetic accommodating region, and projecting toward the other; and a hermetically sealing ring disposed on the other of the inner tray and the inner lid and having a slanted surface movable in frictional contact with the annular ridge while the inner lid is being closed, the hermetically sealing ring being hermetically pressable against the entire periphery of the annular ridge.

With the above arrangement according to the present invention, the refill case which accommodates cosmetic material is installed in one side of the accommodating space opposite to the other side which serves as an empty space. A pair of slide guides are formed horizontally on the respective parallel side walls of the outer peripheral wall of the container housing. A pair of slides are disposed in the inner tray of the refill case for disengageably engaging the pair of slide guides, respectively, to be guided by the slide guides to slide the refill case horizontally from one side of the accommodating space to the other. The refill case can be slid horizontally between both sides of the accommodating space while being guided by the slide guides engaged by the slides. For installing the refill case, the refill case is inserted into one side of the accommodating space and the slides are brought into engagement with the slide guides. After this, the refill case is moved to the other side of the accommodating space to complete the installation of the refill case into the container housing. Since the slide guides and the slides are held in engagement with each other when the refill case is installed, the refill case is prevented from being dislodged from the container housing.

With the refill case installed in one side of the accommodating space, the other side of the accommodating space may be used as an accommodating area for accommodating a make-up instrument such as a powder puff or the like.

For removing the refill case, the refill case is horizontally returned along the slide guides into the other side of the accommodating space, and the slide guides and the slides are brought out of engagement with each other so that the refill case can be taken out of the other side of the accommodating space.

The cosmetic accommodating region defined in the inner tray is opened and closed by an inner lid which is rotatably mounted on the inner tray by a hinge mechanism that projects outwardly from the inner tray. The hinge mechanism is fitted in a groove defined in the outer peripheral wall of the container housing adjacent to the hinge mechanism, in a manner so that it is exposed out of the container housing. Therefore, when the inner lid is rotated, the hinge mechanism does not interfere with the container housing, and can be opened widely and outwardly of the container housing.

When the inner lid is closed to close the cosmetic accommodating region of the inner tray, the cosmetic accommodating region is hermetically sealed by the hermetic sealing mechanism disposed between the inner tray and the inner lid around the cosmetic accommodating region.

Particularly in the hermetic sealing mechanism of the present invention, as the inner lid is closed, the hermetically sealing ring is hermetically pressed against the full periphery of the annular ridge. The annular ridge is disposed on either one of the inner tray or the inner lid so as to surround the cosmetic accommodating region, and is projected toward the other of the inner tray and the inner lid, on which the hermetically sealing ring is disposed. At the same time, the hermetically sealing ring is frictionally contacting and sliding against the annular ridge. Therefore, even if there are cosmetic-material-deposits on the annular ridge and the hermetically sealing ring, those cosmetic-material-deposits can be scraped off by the sliding movement of the annular ridge and the hermetically sealing ring.

The surface of the hermetically sealing ring against which the annular ridge slides is the slanted surface. Consequently, as the inner lid is closed, the annular ridge slides to press progressively and more strongly against the slanted surface of the hermetically sealing ring for effectively scraping off cosmetic-material-deposits. When the inner lid is fully closed, the hermetically sealing ring and the annular ridge are pressed against each other under increased pressing forces.

According to the present invention, when the single operating member of the push-piece is operated while both the outer lid and the inner lid are being closed, the push-piece is rotated, causing the first releasing member to release the first hook and the first engaging tooth out of engagement with each other and also causing the second releasing member to release the second hook and the second engaging tooth out of engagement with each other. Therefore, both the outer lid and the inner lid can be opened with the single push-piece.

According to the present invention, furthermore, a lock mechanism is disposed between the inner tray of the refill case and a pair of side walls of the container housing in a disengageably-engageable manner for locking the refill case installed in one side of the accommodating space to prevent sliding movement, thereby preventing the refill case from freely moving in the accommodating space when the container housing is tilted.

According to the present invention, furthermore, the pair of slide guides and the pair of slides are vertically disengageably-engageable with each other, so that the refill case is detachably installed to the accommodating space of the container housing in the vertical direction. Consequently, the refill case can be installed into and removed from the container housing vertically.

BEST MODE FOR CARRYING OUT THE INVENTION

Figure 1:
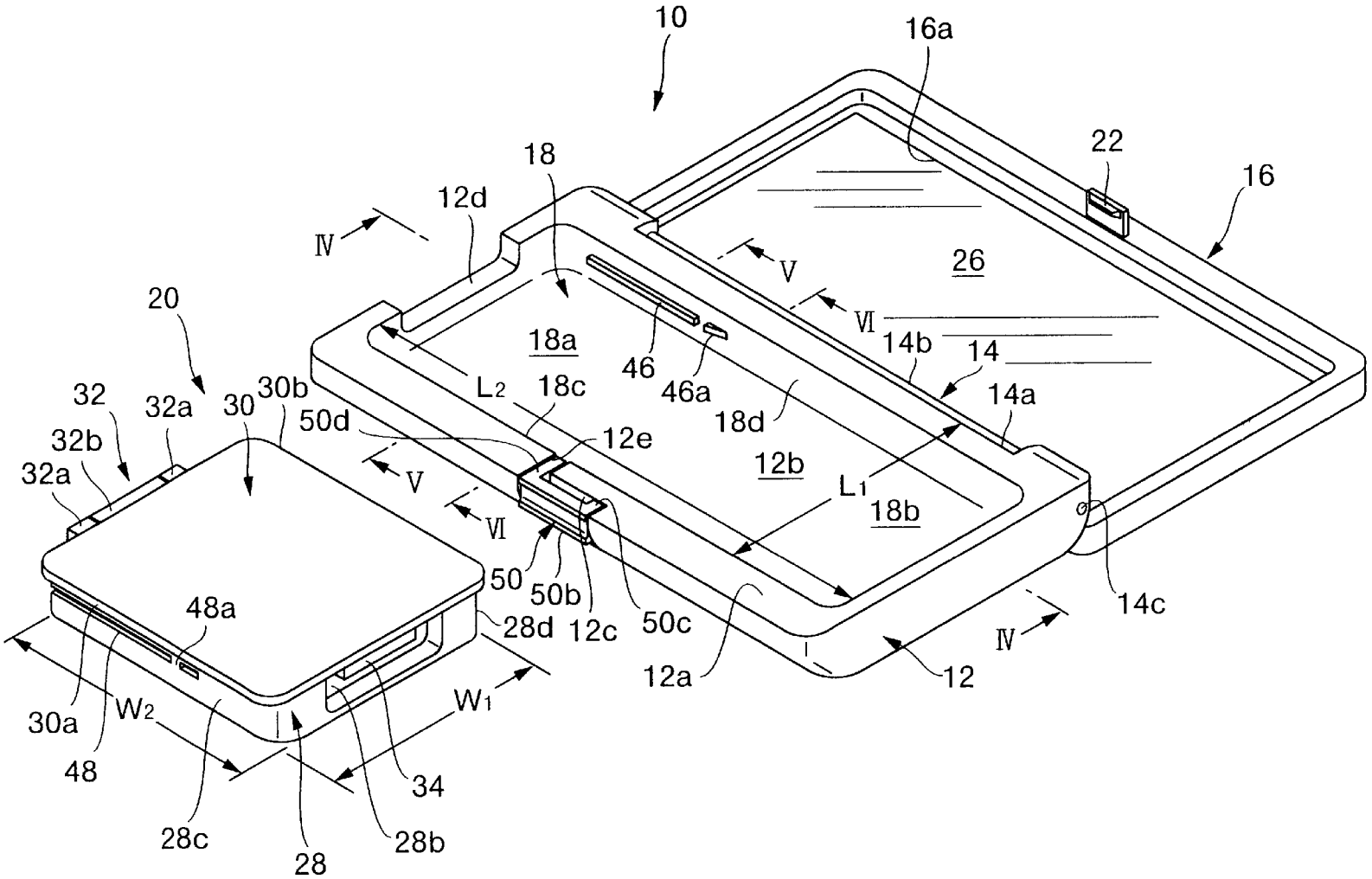
FIG. 1 is a perspective view of a hermetically sealed cosmetic container according to an embodiment of the present invention, the view showing a container housing with an outer lid being open and a refill case removed from the container housing.
Figure 2:
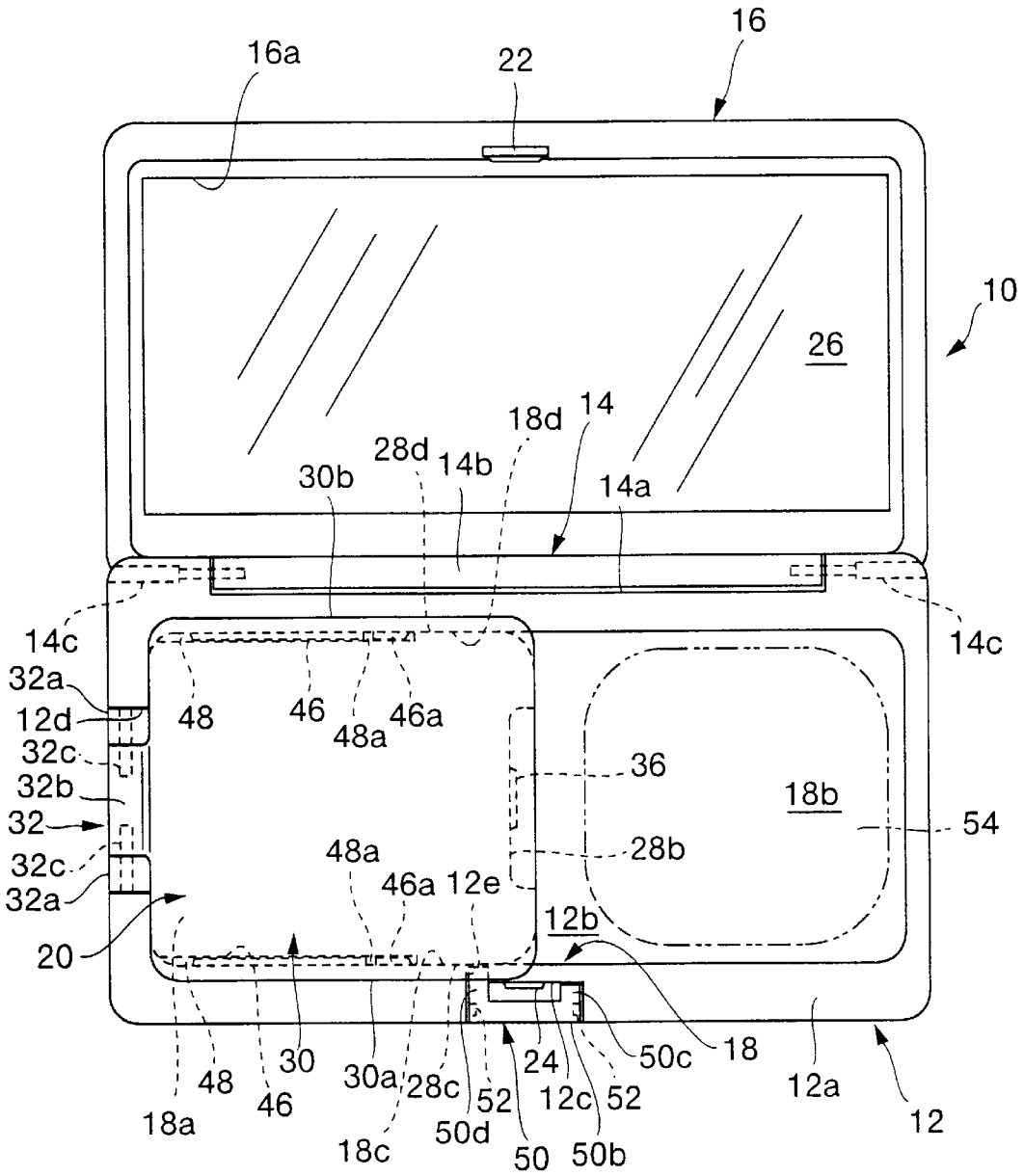
FIG. 2 is a plan view of the hermetically sealed cosmetic container shown FIG. 1 with the outer lid open.

Embodiments of the present invention will hereinafter be described in detail with reference to the accompanying drawings. As shown in FIGS. 1 and 2, a hermetically sealed cosmetic container 10 according to the present embodiment has a container housing 12 and an outer lid 16 hinged to a rear end of the container housing 12 by a first hinge 14. The container housing 12 is of a receptacular shape having an outer peripheral wall 12*a* and a bottom wall 12*b*. The container housing 12 defines therein a rectangular accommodating space 18 according to the outer profile of the container housing 12. A refill case 20 is mounted in one side 18*a* (left-hand side as shown in the Figure) of the accommodating space 18. The first hinge 14 comprises a ledge 14*b* disposed centrally on a rear end of the outer lid 16 and fitted in a recess 14*a* defined centrally in the rear end of the container housing 12, and hinge pins 14*c* inserted from both sides into both the ledge 14*b* and the recess 14*a*. A first hook 22 projects from the center of an openable end of the outer lid 16. When the outer lid 16 is closed, the first hook 22 is disengageably engaged to a first engaging tooth 24 mounted centrally on a front end of the container housing 12. The outer lid 16 remains closed by this engagement. The first engaging tooth 24 is disposed in a cavity 12*c* defined in a front face of the outer peripheral wall 12*a*. A vanity mirror 26 is mounted in a recess 16*a* defined in the reverse side of the outer lid 16.

The refill case 20 is used as a replacement case which accommodates cosmetic material therein. The refill case 20 comprises an inner tray 28 having a cosmetic accommodating region 28*a* capable of being filled with a volatile cosmetic material and an inner lid 30 for closing the upper surface of the inner tray 28. The inner lid 30 has a left end, as shown in the Figure, openably and closably hinged to the inner tray 28 by a second hinge 32 as a hinge mechanism. The second hinge 32 comprises a pair of support teeth 32*a*, 32*a* projecting from the left end of the inner tray 28, a ledge 32*b* projecting from the center of the left end of the inner lid 30, the ledge 32*b* being fitted in a space between the support teeth 32*a*, and hinge pins 32*c* inserted into the support teeth 32*a*, 32*a* and the ledge 32*b*. The second hinge 32 projects from the inner tray 28. The outer peripheral wall 12*a* has an upwardly open groove 12*d* defined in a portion thereof which forms an end portion of the side 18*a* of the accommodating space 18. With the refill case 20 mounted in place, the second hinge 32 is arranged and fitted in the groove 12*d*.

A second hook 34 projects centrally from the free end of the inner lid 30 and is disengageably engaged to a second engaging tooth 36 mounted on the inner tray 28 for thereby keeping the inner lid 30 closed. The second engaging tooth 36 is formed in a cavity 28*b* defined centrally in the right end of the inner tray 28. When the inner lid 30 is closed, the second hook 34 is placed in the cavity 28*b*.

The refill case 20 is fitted in place so that the inner tray 28 has front and rear outer side surfaces 28*c*, 28*d* held substantially in close contact with respective front and rear side walls 18*c*, 18*d* of the accommodating space 18 of the container housing 12, with the second hinge 32 and the second hook 34 being oriented to the right and the left sides, respectively. The inner lid 30 has front and rear side edges 30*a*, 30*b*, which are free of the second hinge 32 and the second hook 34, so wide that they project outwardly from the inner tray 28. Both the widely formed side edges 30*a*, 30*b* are superposed on an upper end of the outer peripheral wall 12*a* of the container housing 12 when the refill case 20 is fitted in the accommodating space 18.

Figure 4:
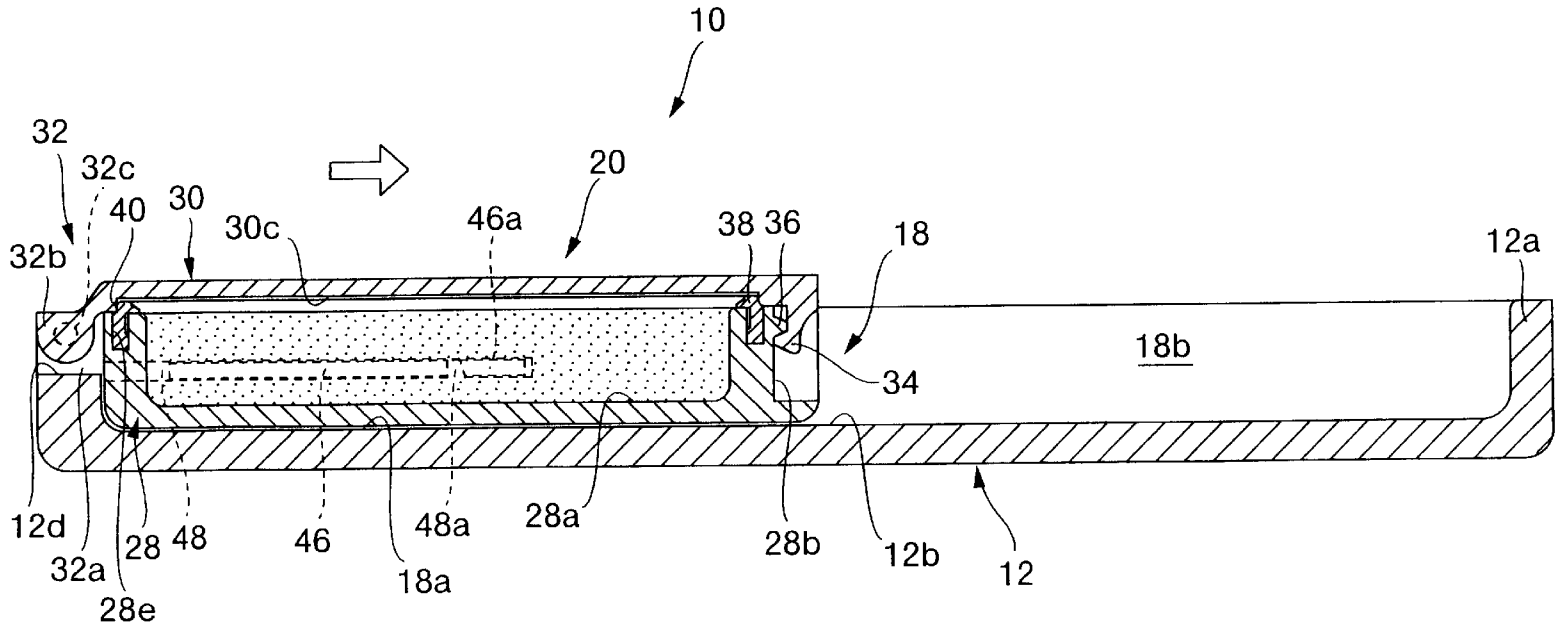
FIG. 4 is a cross-sectional view taken along line IV—IV of FIG. 1, illustrating the hermetically sealed cosmetic container shown in FIG. 1 with the refill case attached thereto.
Figure 5:
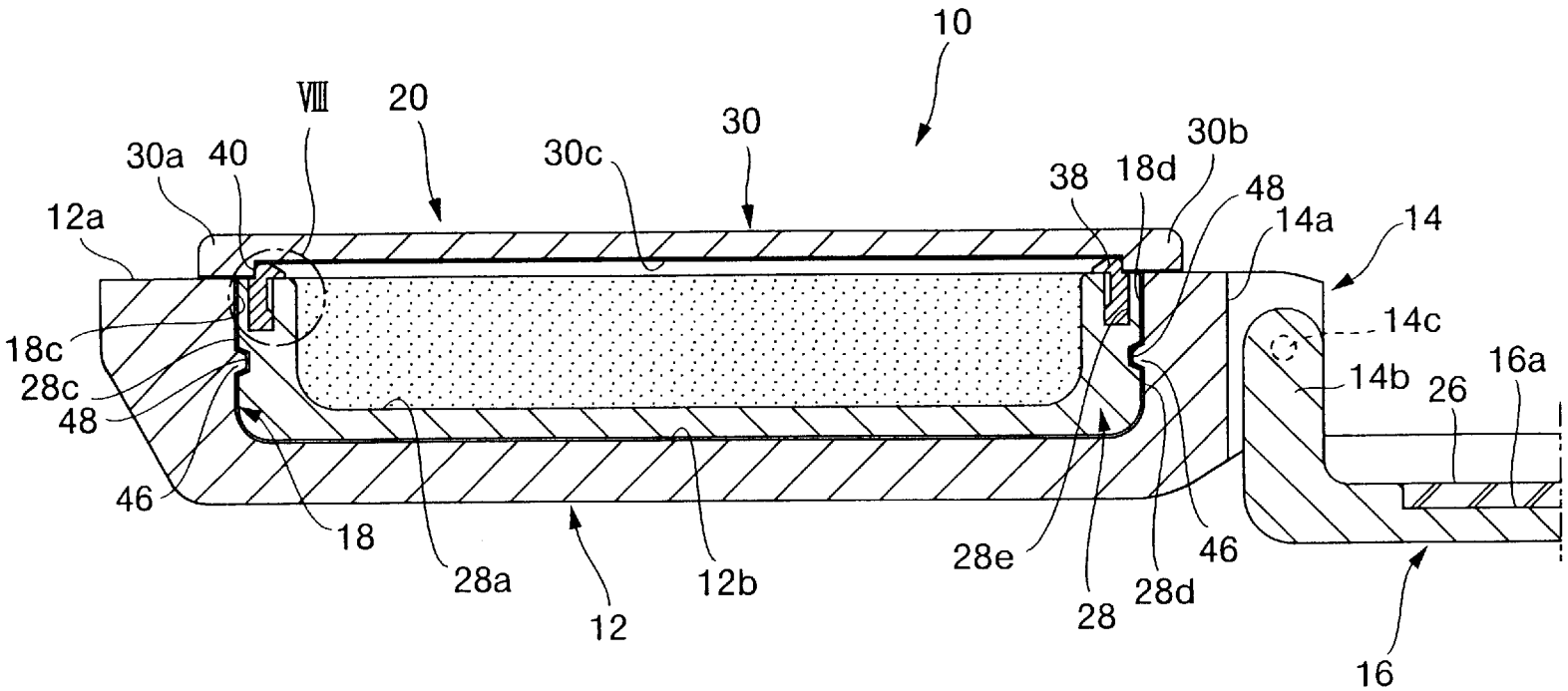
FIG. 5 is a cross-sectional view taken along line V—V of FIG. 1, illustrating the hermetically sealed cosmetic container shown in FIG. 1 with the refill case attached thereto.

A hermetic sealing mechanism for hermetically sealing the cosmetic accommodating region 28*a* is disposed between the inner lid 30 and the inner tray 28. As shown in FIG. 4, the hermetic sealing mechanism comprises a hermetically sealing ring 38 disposed around the opening of the cosmetic accommodating region 28*a* and an annular ridge 40 on the inner lid 30 which extends along the hermetically sealing ring 38.

Figure 8:
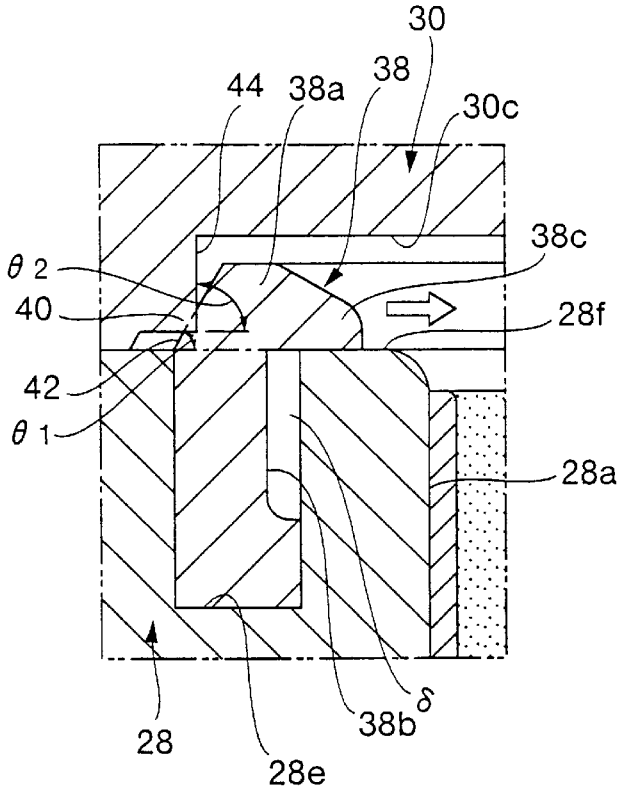
FIG. 8 is an enlarged cross-sectional view of portion VIII shown in FIG. 5, of the hermetically sealed cosmetic container shown in FIG. 1.

The hermetically sealing ring 38 is comprised of a band-like ring made of a general sealing material such as rubber or the like. As shown in FIG. 8, the hermetically sealing ring 38 is pressed into an annular groove 28*e* defined around the opening of the cosmetic accommodating region 28*a*, and has an upper portion projecting as an upward protrusion 38*a* from the upper end of the opening of the cosmetic accommodating region 28*a*. The hermetically sealing ring 38 also has an annular groove 38*b* defined peripherally in the inner peripheral surface thereof immediately below the protrusion 38*a*. The annular groove 38*b* serves to reduce the thickness of the hermetically sealing ring 38 to impart an elastic function thereto, and it defines a gap 6 between the hermetically sealing ring 38 and the inner surface of the annular groove 28*e* for allowing the hermetically sealing ring 38 to be elastically deformed in the radially inward direction. The hermetically sealing ring 38 further has an annular inner flange 38*c* projecting radially inwardly from the aforesaid protrusion 38*a* and slidably supported on an inner flat surface 28*f* around the cosmetic accommodating region 28*a*. The hermetically sealing ring 38 also has a first slanted surface 42 disposed on an outer periphery of the aforesaid protrusion 38*a* and inclined outwardly of the inner tray 28 with its outer diameter progressively increasing along the downward direction.

The inner lid 30 has a recess 30*c* defined in the reverse surface thereof at a position corresponding with the cosmetic accommodating region 28*a*. The recess 30*c* has a peripheral edge with a step-like projecting portion which serves as the annular ridge 40. The annular ridge 40 has a second slanted surface 44 which confronts the first slanted surface 42 of the protrusion 38*a* from the above side and which is inclined at an angle θ2 that is greater than an angle θ1 of the first slanted surface 42. Because the angle θ2 of the second slanted surface 44 is greater than the angle θ1 of the first slanted surface 42, when the inner lid 30 starts to close, the annular ridge 40 is first brought into contact with the protrusion 38*a*. Thereafter, when the inner lid 30 is further closed, the inner peripheral corner of the annular ridge 40 moves while scrubbing against the first slanted surface 42 of the hermetically sealing ring 38. In this embodiment, the angle 62 of the second slanted surface 44 is at right angle.

As shown in FIG. 1, the rectangular accommodating space 18 defined in the container housing 12 has a length L1 between its front and rear ends which is substantially equal to a width W1 between the front and rear ends of the inner tray 28, and a length L2 between its left and right ends which is substantially twice the width W2 between the left and right ends of the inner tray 28. In the side 18*a* of the accommodating space 18 which accommodates the refill case 20, the pair of side walls 18*c*, 18*d* which confront each other and extend parallel to each other have respective slide guides 46 comprised of a pair of ridges and extending parallel to the bottom wall 12*b* of the accommodating space 18. The side surfaces 28*c*, 28*d* of the inner tray 28 of the refill case 20, which confront the side walls 18*c*, 18*d*, respectively, have slides 48 comprised of grooves defined respectively therein, into which the slide guides 46 are disengageably engaged, respectively. When the slide guides 46 and the slides 48 are relatively slid while in engagement, the refill case 20 is slid between the side 18*a* of the accommodating space 18 and the other side 18*b* thereof. The slide guides 46 have respective teeth 46*a* near their ends closer to the side 18*b* and which are spaced therefrom by gaps, the respective teeth 46*a* having slanted surfaces. The slides 48 include respective bridges 48*a* which will move over the teeth 46*a* and snap into the gaps when the inner tray 28 is placed into the accommodating space 18. The teeth 46*a* and the bridges 48*a* are disengageably engageable with each other for thereby preventing the refill case 20 from freely moving in the accommodating space 18 when the container housing 12 is tilted.

Figure 3:
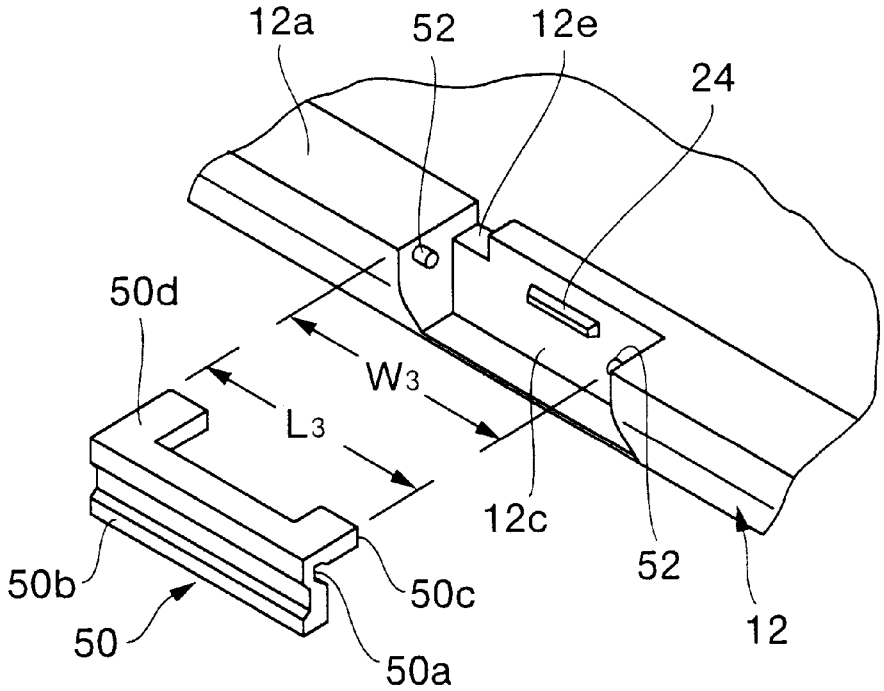
FIG. 3 is a fragmentary perspective view of the container housing, from which a push-piece is detached, of the hermetically sealed cosmetic container shown in FIG. 1.

The container housing 12 has a push-piece 50 for releasing the first hook 22 of the outer lid 16 and the second hook 34 of the inner lid 30 from engagement with each other. As shown in FIG. 3, the push-piece 50 is placed in the cavity 12*c* defined centrally in the front end of the container housing 12. The push-piece 50 has a length L3 which is substantially equal to a width W3 of the cavity 12*c* between its left and right ends. The push-piece 50 has a laterally opened pivot hole 50*a* defined in an upper end thereof and fitted over a pair of support shafts 52 projecting from both inner surfaces of the cavity 12*c*, and hence is rotatably supported for rotating about the support shafts 52. The push-piece 50 has an operating member 50*b* projecting slightly forward from the lower end thereof, and also includes a first releasing member 50*c* projecting horizontally backward from the right end of its upper end and a second releasing member 50*d* projecting horizontally backward from the left end of its upper end. As shown in FIG. 2, the first releasing member 50*c* has a length up to the surface of the cavity 12*c* on which the first engaging tooth 24 is mounted, and the second releasing member 50*d* has a length up to a position immediately below the edge of the inner lid 30 of the refill case 20 by passing through a recess 12*e* defined in an upper portion of the cavity 12*c*. The tip end of the first releasing member 50*c* is positioned below the outer lid 16, and the tip end of the second releasing member 50*d* is positioned below the inner lid 30.

Figure 6:
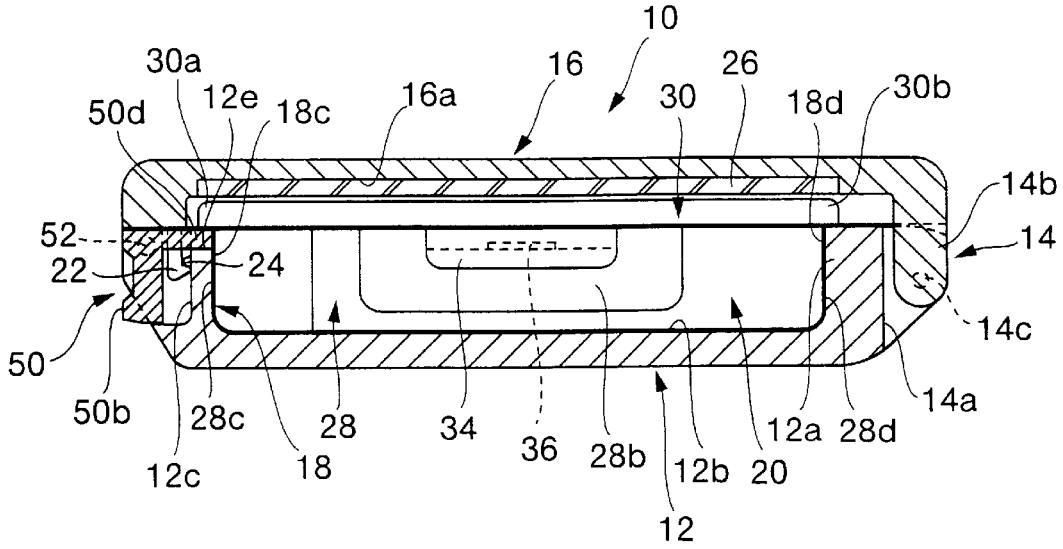
FIG. 6 is a cross-sectional view taken along line VI—VI of FIG. 1, illustrating the hermetically sealed cosmetic container shown in FIG. 1 with the outer and inner lids closed.
Figure 7:
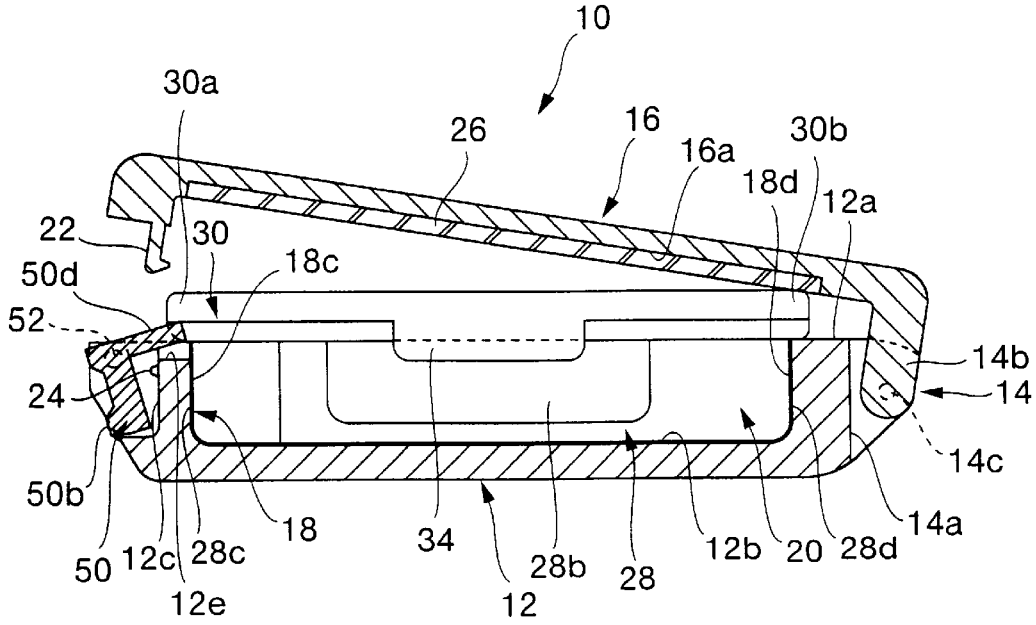
FIG. 7 is a cross-sectional view similar to FIG. 6, illustrating the hermetically sealed cosmetic container shown in FIG. 1 with the outer and inner lids being about to be opened.

In the hermetically sealed cosmetic container 10 with the above-mentioned structure according to this embodiment, when the outer lid 16 and the inner lid 30 are closed, the first hook 22 is engaged to the first engaging tooth 24, keeping the outer lid 16 closed, as shown in FIG. 6, and the second hook 34 is engaged to the second engaging tooth 36, keeping the inner lid 30 closed, as shown in FIG. 4. When the push-piece 50 disposed centrally on the front end of the container housing 12 is pushed, the outer and inner lids 16, 30 can be opened, allowing the user to use the cosmetic material in the refill case 20. Specifically, when the operating member 50*b* on the lower end of the push-piece 50 is pressed, the push-piece 50 is rotated about the support shafts 52, lifting the first and second releasing members 50*c*, 50*d* upwards. The first and second releasing members 50*c*, 50*d* impart upward pushing forces to the outer lid 16 and the inner lid 30, releasing the first hook 22 and the first engaging tooth 24 out of engagement with each other and also releasing the second hook 34 and the second engaging tooth 36 out of engagement with each other, whereupon the outer lid 16 and the inner lid 30 are slightly opened, as shown in FIG. 7. The outer lid 16 can then be manually opened, and thereafter the inner lid 30 can be manually opened in the same manner.

Therefore, in this embodiment, when opening the inner and outer lids 16,30, since the outer lid 16 and the inner lid 30 can be opened altogether by one press of the single push-piece 50 rotatably mounted on the container housing 12, the process of opening the lids when using the cosmetic material is highly simplified even though the hermetically sealed cosmetic container 10 has a detachable refill case 20. Though both the outer lid 16 and the inner lid 30 can be opened by a single action of the push-piece 50, since the push-piece 50 is rotated, the space required for the push-piece 50 may be small, and the hermetically sealed cosmetic container 10 may be reduced in size.

When the inner lid 30 of the refill case 20 is opened, the second hinge 32 does not interfere with the outer peripheral wall 12*a* because the second hinge 32 projecting from the left end of the refill case 20 is disposed in the groove 12*d* defined in the outer peripheral wall 12*a*. Thus, the inner lid 30 can be opened widely outwardly of the container housing 12 for thereby allowing the user to use the cosmetic material with ease. As shown in FIG. 7, when the outer lid 16 and the inner lid 30 are opened by releasing the first and second hooks 22, 34, a rear corner of the inner lid 30 pushes up the reverse side of the outer lid 16. (This is the surface of the vanity mirror 26 in this embodiment.) Therefore, the outer lid 16 can initially be opened to a large angle by the action of the push-piece 50.

After make-up, the inner lid 30 is first closed and then the outer lid 16 is closed. The first hook 22 and the first engaging tooth 24 are brought into engagement with each other, and the second hook 34 and the second engaging tooth 36 are brought into engagement with each other, keeping the outer lid 16 and the inner lid 30 closed. With the inner lid 30 closed, the inner tray 28 remains highly hermetically sealed by the hermetically sealing ring 38. Specifically, as for the refill case 20, as the inner lid 30 is progressively closed, the inner corner of the annular ridge 40 formed on the inner lid 30 abuts against the first slanted surface 42 outward of the protrusion 38*a* of the hermetically sealing ring 38 on the inner tray 28. As the inner lid 30 is further closed, the annular ridge 40 frictionally moves downwardly while frictionally contacting and sliding against the first slanted surface 42. Even if cosmetic-material-deposits are present on the hermetically sealing ring 38 provided around the opening of the cosmetic material accommodating region 28*a* and the annular ridge 40 of the inner lid 30, those cosmetic-material-deposits are scraped off the hermetically sealing ring 38 and the annular ridge 40 by the sliding engagement of the annular ridge 40 and the hermetically sealing ring 38 before the inner lid 30 is fully closed. Accordingly, both engaging surfaces are kept clean at all times.

Because the first slanted surface 42 of the hermetically sealing ring 38 slides against the annular ridge 40, as the inner lid 30 is progressively closed, the annular ridge 40 slides progressively and more strongly against the protrusion 38*a*, thus effectively scraping off cosmetic-material-deposits. When the inner lid 30 is completely closed, the cosmetic accommodating region 28*a* is highly hermetically sealed because the first slanted surface 42 and the annular ridge 40 are pressed against each other under sufficient pressing forces and also because cosmetic-material-deposits are scraped off. Even though the cosmetic material accommodated in the cosmetic accommodating region 28*a* is a volatile cosmetic material, volatile constituents of the cosmetic material are prevented from spreading out, and hence the quality thereof can be maintained for a long period of time.

In the hermetic sealing mechanism according to this embodiment, the protrusion 38*a*, which performs a substantial sealing function of the hermetically sealing ring 38, projects upwardly from the upper surface of the inner tray 28 around the opening of the cosmetic accommodating region 28*a*. Therefore, the position above the cosmetic accommodating region 28*a* is sealed by the protrusion 38*a*. Unlike the conventional structure in which the cosmetic accommodating region 28*a* is sealed in a lower portion thereof by an annular recess defined around the cosmetic accommodating region 28*a*, only the annular groove 28*e* for installing the hermetically sealing ring 38 needs to be defined around the cosmetic accommodating region 28*a*. The opening area of the cosmetic accommodating region 28*a* may thus be made larger, increasing the amount of the accommodated cosmetic material without increasing the size of the hermetically sealed cosmetic container 10. The hermetically sealing ring 38 fitted in the annular groove 28*e* is radially and elastically deformable by the gap δ. Since the inner flange 38*c* of the hermetically sealing ring 38 of the present embodiment is slidably supported on the inner flat surface 28*f*, the inner peripheral side of the hermetically sealing ring 38 which would otherwise tend to fall by forced contact with the annular ridge 40 is borne by the inner flat surface 28*f*. As a result, the necessary elastic deformability is appropriately imparted to the sealing member while assuring that the annular ridge 40 is capable of removing cosmetic-material-deposits with the above-described sliding movement.

In this embodiment, for installing the refill case 20 in the accommodating space 18 in the container housing 12, the slide guides 46 on the front and rear side walls 18*c*, 18*d* of the accommodating space 18 and the slides 48 in the front and rear side surfaces 28*c*, 28*d* of the inner tray 28 are brought into interfitting engagement with each other and slide against each other, so that the refill case 20 can slide from one side 18*b* into the other side 18*a* of the accommodating space 18. Upon removal, on the contrary, the refill case 20 is caused to slide back from the side 18*a* to side 18*b* of the accommodating space 18. With the refill case 20 installed in position, the side 18*b* of the accommodating space 18 is an empty space, and make-up instruments such as a powder puff 54 or the like may be placed in the empty space 18*b*.

With the refill case 20 mounted in place, since the slide guides 46 and the slides 48 are held in engagement with each other, the refill case 20 is prevented from being dislodged from the container housing 12. Because the refill case 20 is installed and detached by sliding movement in the accommodating space 18, there is no partition wall present between the installing space 18*a* for the refill case 20 and the make-up instrument accommodating space 18*b*, unlike the conventional arrangements. Therefore, the accommodating space 18 is moldable as a continuous space as a whole, and hence is simple in structure. Therefore, the mold structure for manufacturing the container housing 12 may be simplified.

The slide guides 46 and the slides 48 basically serve to slide the refill case 20 in the accommodating space 18. In addition, the amount of projection of the slide guides 46 and the depth of the slides 48 may be adjusted to allow them to engage with each other vertically, so that the refill case 20 may directly be installed into and removed from the side 18*a* of the accommodating space 18 in the vertical direction. If the refill case 20 can vertically be installed into and removed from the accommodating space 18, then the refill case 20 can be installed and detached without having to remove the powder puff 54 placed in side 18*b* of the accommodating space 18 upon each installation and detachment.

Figure 9:
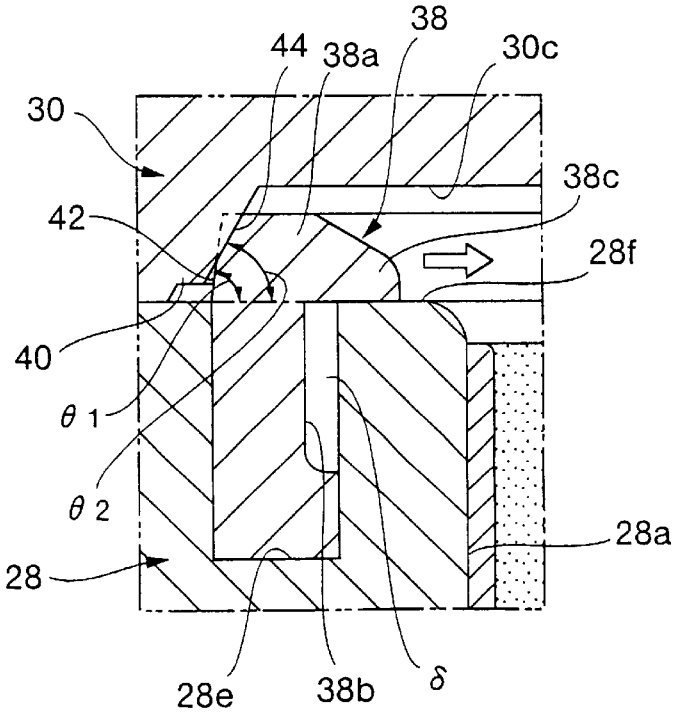
FIGS. 9 through 18 are enlarged cross-sectional views similar to FIG. 8, showing other hermetical sealing mechanisms that are applicable to the hermetically sealed cosmetic container according to the present invention.
Figure 10:
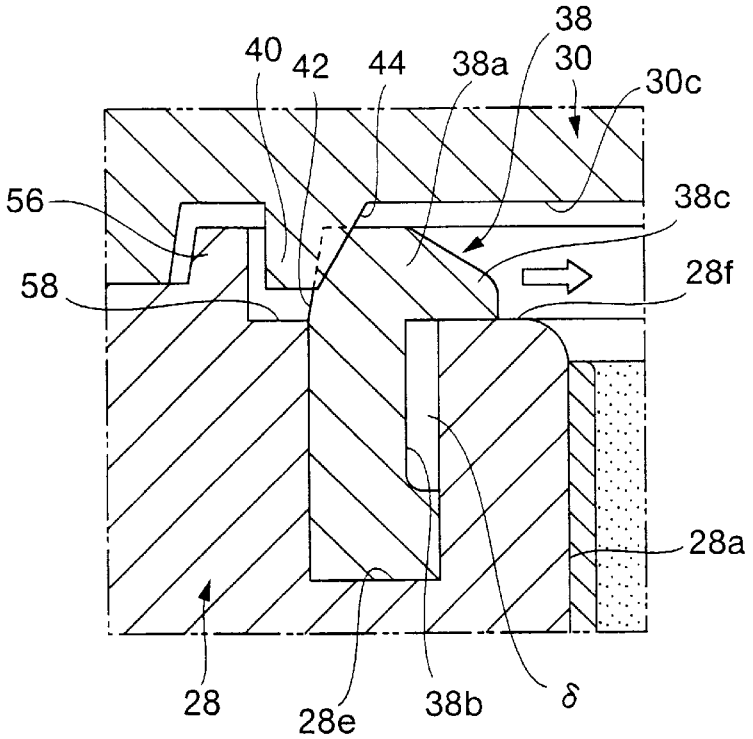
Figure 11:
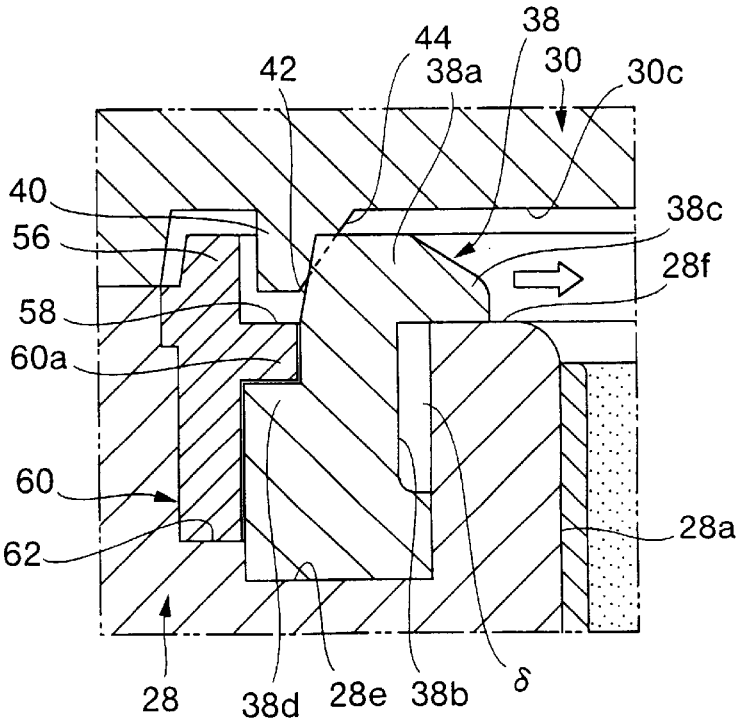
Figure 14:
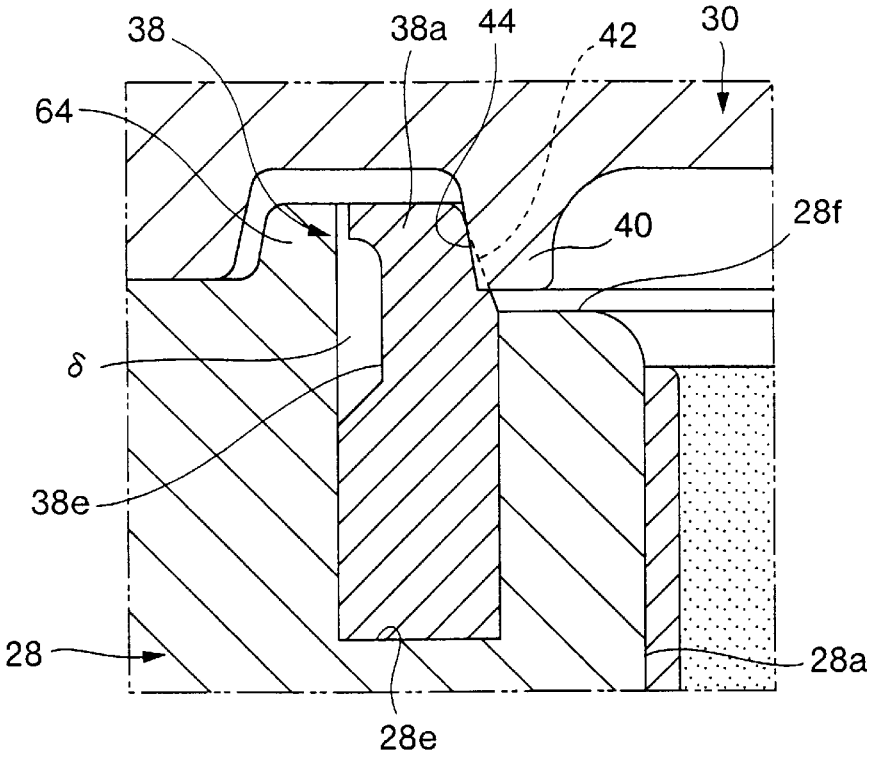
Figure 15:
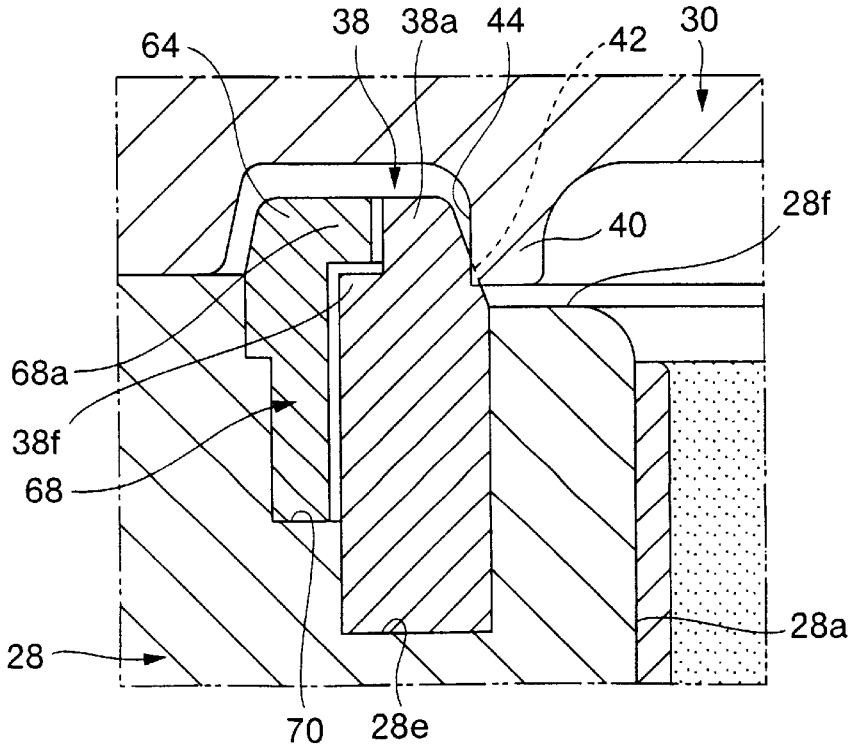
Figure 16:
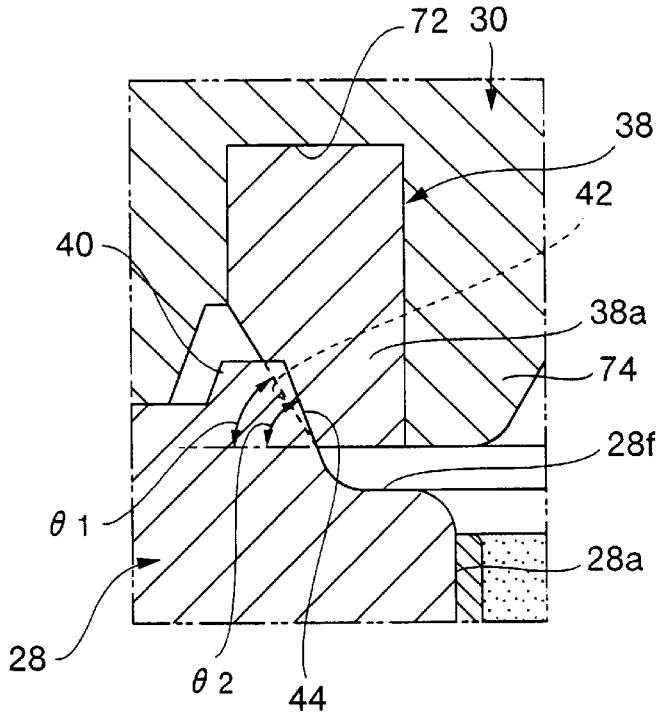
Figure 17:
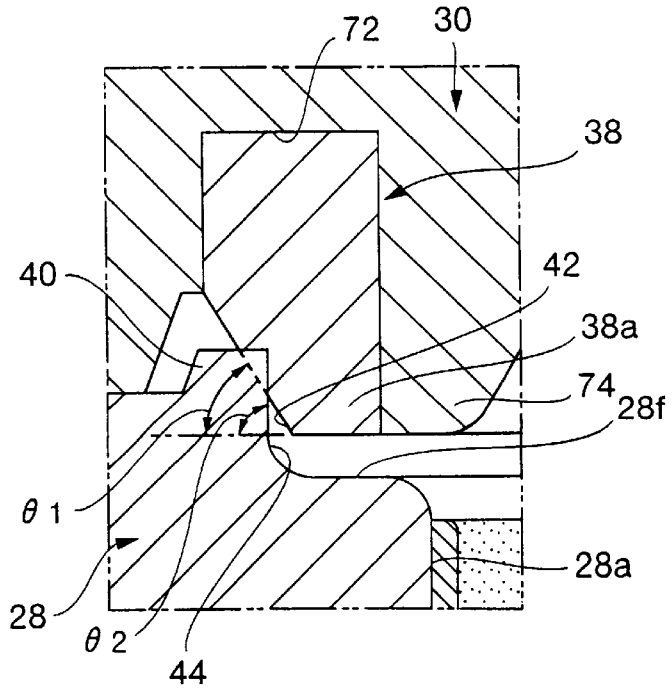
Figure 18:
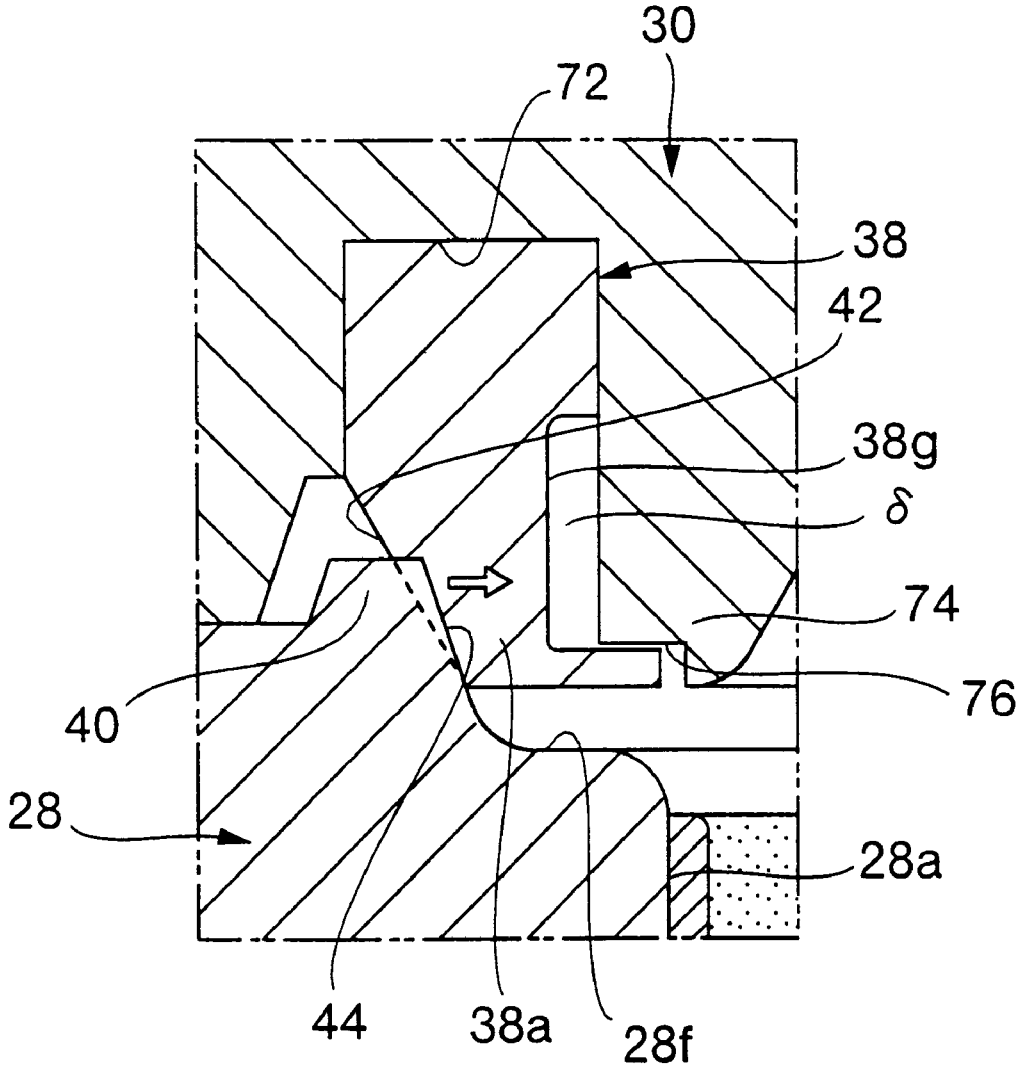

FIGS. 9 through 18 are enlarged cross-sectional views similar to FIG. 8, showing other embodiments of the hermetic sealing mechanisms for the cosmetic accommodating region 28*a* of the refill case 20. Each of the other embodiments will be described below in order. The component parts which are identical to those of the above embodiment are denoted by identical reference numerals, and duplicating explanation will be omitted. FIGS. 9 through 11 show types in which a hermetically sealing ring 38 is disposed on an inner tray 28 and an annular ridge 40 disposed on an inner lid 30 is pressed against the outer periphery of a protrusion 38*a* of the hermetically sealing ring 38, as is the case with the above embodiment. FIGS. 12 through 15 show types in which an annular ridge 40 disposed on an inner lid 30 is pressed against the inner periphery of a protrusion 38*a* of a hermetically sealing ring 38 disposed on an inner tray 28. FIGS. 16 through 18 show types in which a hermetically sealing ring 38 is disposed on an inner lid 30 and an annular ridge 40 is disposed on an inner tray 28.

More specifically, in a hermetic sealing mechanism according to an embodiment shown in FIG. 9, the angle . 2 of a second slanted surface 44 of the annular ridge 40 disposed on the inner lid 30 is smaller than the angle θ1 of a first slanted surface 42 of the protrusion 38*a* of the hermetically sealing ring 38. This embodiment offers the same operation and advantages as those of the above embodiment. While the angle θ2 of the second slanted surface 44 is smaller than right angle, the same operation and advantages can be attained even if the angle θ2 is greater than right angle.

In a hermetic sealing mechanism according to an embodiment shown in FIG. 10, an upwardly projecting annular ridge 56 is integrally formed with the upper end of the inner tray 28 in spaced relationship to the outer periphery of the hermetically sealing ring 38. The annular ridge 56 separates the inner and outer regions of the cosmetic accommodating region 28*a* from each other. An upper surface of the inner tray 28 which is outside the annular ridge 56 is higher than an inner flat surface 28*f*.

This embodiment offers the same operation and advantages as those of the above embodiments, but is also capable of holding scraped cosmetic-material-deposits in a clearance 58 between the annular ridge 56 and the hermetically sealing ring 38 for preventing scattering.

In a hermetic sealing mechanism according to an embodiment shown in FIG. 11, an annular ridge 56 is disposed on a ring 60 separate from the inner tray 28, and the ring 60 is fitted around the outer periphery of the hermetically sealing ring 38. There is formed a fitting groove 62 around the outer periphery of the hermetically sealing ring 38, and the ring 60 is fitted in the fitting groove 62. The ring 60 has an inner flange 60*a* on the inner periphery thereof which presses the upper end of an outer flange 38*d* projecting on the outer periphery of the lower end of the hermetically sealing ring 38.

This embodiment offers the same operation and advantages as those of the embodiment shown in FIG. 10. Furthermore, since the hermetically sealing ring 38 is subsequently pressed down by the ring 60 after the hermetically sealing ring 38 is placed in an annular groove 28*e*, the hermetically sealing ring 38 which is made of an elastic material can be assembled efficiently.

Figure 12:
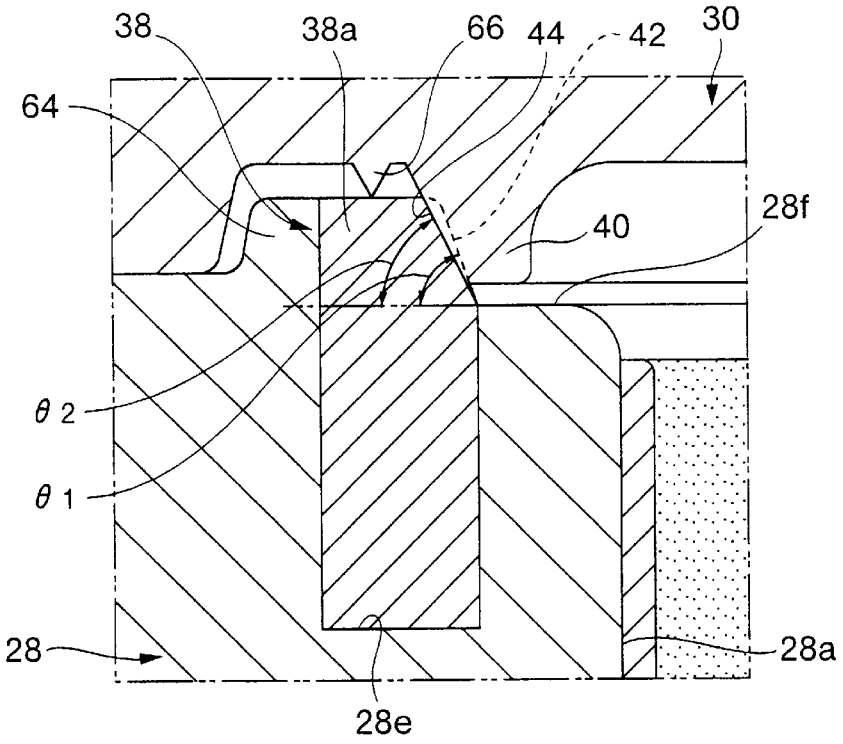

In a hermetic sealing mechanism according to an embodiment shown in FIG. 12, the hermetically sealing ring 38 is fitted in the annular groove 28*e* defined around the opening of the cosmetic accommodating region 28*a* in the inner tray 28, and the first slanted surface 42 is disposed on the inner side of the protrusion 38*a* of the hermetically sealing ring 38. The inner lid 30 has an annular ridge 40 at a position corresponding to the inner periphery of the hermetically sealing ring 38, and a second slanted surface 44 is disposed on the outer side of the annular ridge 40. The angle θ1 of the first slanted surface 42 is greater than the angle θ2 of the second slanted surface 44. In this embodiment, an elevation 64 having a height which is substantially the same as the upper end of the protrusion 38*a* of the hermetically sealing ring 38 is disposed on the outer peripheral edge of the annular groove 28*e* for preventing the protrusion 38*a* from falling outwardly. The inner lid 30 has a sealing tooth 66 confronting the upper end of the protrusion 38*a*. When the inner lid 30 is closed, the sealing tooth 66 is pressed against the upper end of the protrusion 38*a*.

According to this embodiment, alike the above-mentioned embodiments, when the inner lid 30 is closed, the second slanted surface 44 of the annular ridge 40 slides against the first slanted surface 42 of the hermetically sealing ring 38 for thereby scraping cosmetic-material-deposits off the slanted surfaces 42, 44 for an increased sealing capability. Since the sealing tooth 66 is pressed against the protrusion 38*a* of the hermetic sealing ring 38 when the inner lid 30 is closed, the pressed surfaces also provide a seal for an increased sealing capability.

Figure 13:
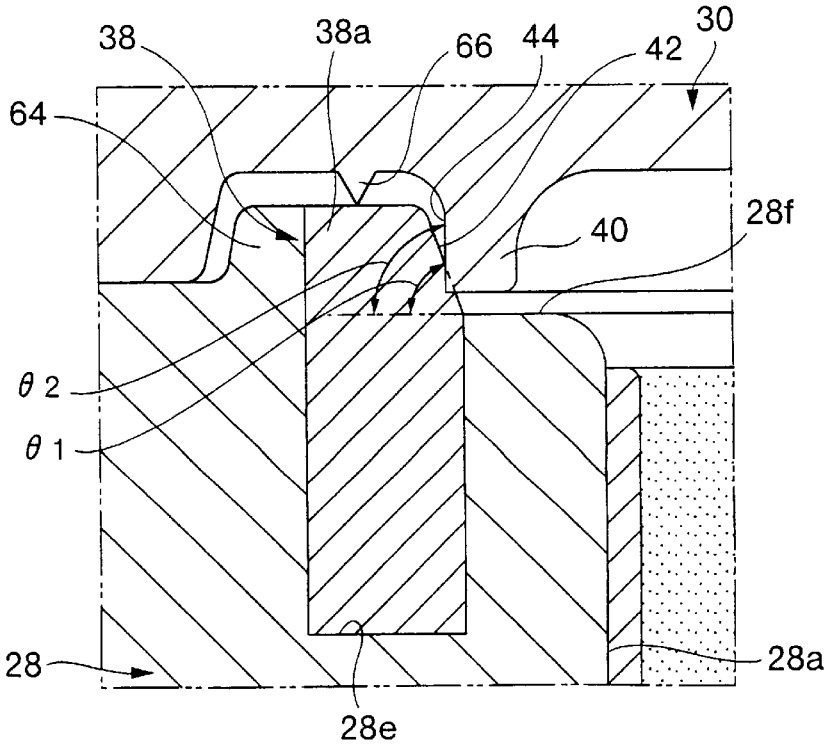

In a hermetic sealing mechanism according to an embodiment shown in FIG. 13, the angle θ2 of the second slanted surface 44 of the annular ridge 40 is substantially at right angle so as to be greater than the first slanted surface 42 of the protrusion 38*a* of the hermetically sealing ring 38. This embodiment offers the same operation and advantages as those of the above embodiment. The angle θ2 of the second slanted surface 44 may be greater than right angle.

In a hermetic sealing mechanism according to an embodiment shown in FIG. 14, an annular groove 38*e* is defined in the hermetically sealing ring 38 near the upper end of the outer periphery thereof, on the opposite side of the first slanted surface 42. The annular groove 38*e* serves to reduce the thickness of the hermetically sealing ring 38 to increase the elastic function thereof, and defines a gap 6 between the outer surface of the annular groove 28*e* for allowing the hermetically sealing ring 38 to be elastically deformed in a radially outward direction. In this embodiment, the groove 38*e* is effective to increase pressing forces, and the pressing engagement between the first and second slanted surfaces 42, 44 under resilient forces produced by elastic deformation of the hermetically sealing ring 38 is capable of increasing the hermetic sealability of a cosmetic accommodating region 28*a*.

In a hermetic sealing mechanism according to an embodiment shown in FIG. 15, the elevation 64 is disposed on a ring 68 separate from the inner tray 28, and fitted around the outer periphery of the hermetically sealing ring 38. There is formed a fitting groove 70 defined around the outer periphery of the hermetically sealing ring 38, and the ring 68 is fitted in the fitting groove 70. The ring 68 has an inner flange 68*a* on its inner periphery which presses the upper end of the outer flange 38*f* projecting on the outer periphery of the lower end of the hermetically sealing ring 38.

This embodiment offers the same operation and advantages as those of the embodiment shown in FIG. 13. Furthermore, since the hermetically sealing ring 38 is subsequently pressed down by the ring 68 after the hermetically sealing ring 38 is placed in the annular groove 28*e*, the hermetically sealing ring 38 which is made of an elastic material can be assembled efficiently.

In a hermetic sealing mechanism according to an embodiment shown in FIG. 16, the annular ridge 40 projects upwardly and integrally from the inner tray 28 around the cosmetic accommodating region 28*a*, and the inner lid 30 has an annular groove 72 in a position corresponding to the annular ridge 40, with a hermetically sealing ring 38 fitted in the annular groove 72. The hermetically sealing ring 38 has a protrusion 38*a* on its lower end which has a first slanted surface 42 on its outer periphery. The annular ridge 40 has a second slanted surface 44 on its inner periphery in confronting relation to the first slanted surface 42. The angle θ1 of the first slanted surface 42 is smaller than the angle θ2 of the second slanted surface 44. The upper surface of the inner tray 28 which is outside of the annular ridge 40 is formed at a higher level than the inner flat surface 28*f* inside of the annular ridge 40. There is provided a hanging wall 74 projecting on the inner peripheral edge of the annular groove 72 to a position which is substantially the same as the lower end of the protrusion 38*a* of the hermetically sealing ring 38. The hanging wall 74 serves to prevent the protrusion 38*a* from falling over.

In this embodiment, when the inner lid 30 starts being closed, the lower end of the first slanted surface 42 formed in the protrusion 38*a* of the hermetically sealing ring 38 on the side of the inner lid 30 abuts against the upper end of the second slanted surface 44 of the annular ridge 40 on the inner tray 28. When the inner line 30 is further closed, the first slanted surface 42 frictionally moves downwardly as it slides against the second slanted surface 44. Even if there are cosmetic-material-deposits on the annular ridge 40 around the opening of the cosmetic accommodating region 28*a* and the hermetically sealing ring 38 on the inner lid 30, these cosmetic-material-deposits are scraped off from between the hermetically sealing ring 38 and the annular ridge 40 by the sliding engagement between the annular ridge 40 and the hermetically sealing ring 38 before the inner lid 30 is fully closed. Accordingly, both portions can be kept in a clean condition at all times. Thus, this embodiment offers the same operation and advantages as those of the above embodiments.

In a hermetic sealing mechanism according to an embodiment shown in FIG. 17, the angle θ2 of the second slanted surface 44 of the annular ridge 40 projecting from the inner tray 28 is substantially at right angle so as to be greater than that of the first slanted surface 42 of the protrusion 38*a* of the hermetically sealing ring 38. This embodiment offers the same operation and advantages as those of the above embodiment. The angle θ2 of the second slanted surface 44 may be greater than right angle.

In a hermetic sealing mechanism according to an embodiment shown in FIG. 18, an annular groove 38*g* is defined in the hermetically sealing ring 38 near the upper end of the inner periphery thereof on the opposite side of the first slanted surface 42. The annular groove 38*g* serves to reduce the thickness of the hermetically sealing ring 38 to increase the elastic function thereof, and defines a gap 6 between the outer surface of an annular groove 72 for allowing the hermetically sealing ring 38 to be elastically deformed in the radially inward direction. In this embodiment, the groove 38*g* is effective to increase pressing forces. Also, the pressing engagement between the first and second slanted surfaces 42, 44 under resilient forces produced by elastic deformation of the hermetically sealing ring 38 is capable of increasing the hermetic sealability of a cosmetic accommodating region 28*a*. When the protrusion 38*a* is pressed against the annular ridge 40, the inner peripheral edge of the hermetically sealing ring 38 which is pushed inwardly is slidably borne by a recess 76 defined in the lower end of the hanging wall 74. Consequently, the necessary elastic deformability is appropriately imparted to the sealing member while assuring that the annular ridge 40 is capable of removing cosmetic-material-deposits with its sliding movement.

There have been disclosed in the above embodiments: the slide mechanism which comprises the slide guides 46 and the slides 48 between the inner tray 28 of the refill case 20 and the accommodating space 18, the structure of the groove 12*d* defined in the outer peripheral wall 12 for holding the second hinge 32 of the refill case 20, the hermetic sealing mechanism comprising the hermetically sealing ring 38 and the annular ridge 40, and the rotatable push-piece 50. The above embodiments are merely given by way of illustrative example to achieve the object of the present invention, and therefore, the slide mechanism, the groove 12*d*, the hermetic sealing mechanism, and the push-piece 50 may be of other structures than those disclosed in the above embodiments.

In the hermetically sealed cosmetic containers according to the present invention, as described above, the refill case which accommodates cosmetic material is installed in one side of the accommodating space formed in the container housing opposite to the other side serving as an empty space. The pair of slide guides are mounted horizontally on the pair of parallel side walls of the outer peripheral wall of the container housing, respectively, and the pair of slides are disposed in the inner tray of the refill case for disengageably engaging the pair of slide guides, respectively, and being guided by the slide guides to slide the refill case horizontally from one side of the accommodating space to the other. The refill case can be installed to and removed from the container housing by horizontally sliding the refill case between one side of the accommodating space to the other while being guided by the slide guides engaged by the slides. Since the slide guides and the slides are held in engagement with each other, when the refill case is installed, the refill case is prevented from being dislodged from the container housing. Because the refill case is installed and removed by sliding action in the accommodating space, there is no need to provide a partition wall which would otherwise been present between the refill case installing space and the make-up instrument accommodating space as is the case with the conventional arrangements. Therefore, the accommodating space is moldable as a continuous space as a whole and hence is simple in structure. Therefore, the mold structure for manufacturing the container housing may be simplified.

With the refill case installed in one side of the accommodating space, the other side of the accommodating space may be used as an accommodating area for accommodating make-up instruments such as a powder puff or the like.

The cosmetic accommodating region defined in the inner tray is opened and closed by the inner lid which is rotatably mounted on the inner tray by a hinge mechanism that projects outwardly from the inner tray. The hinge mechanism is fitted in the groove defined in the outer peripheral wall of the container housing adjacent to the hinge mechanism to expose the hinge mechanism out of the container housing. Therefore, when the inner lid is rotated, the hinge mechanism does not interfere with the outer peripheral wall of the container housing, and can be opened widely outwardly of the container housing.

When the inner lid is closed to close the cosmetic accommodating region of the inner tray, the cosmetic accommodating region is hermetically sealed by the hermetic sealing mechanism disposed between the inner tray and the inner lid around the cosmetic accommodating region.

Especially in the hermetic sealing mechanism of the present invention, as the inner lid is closed, the hermetically sealing ring is hermetically pressed against the full periphery of the annular ridge, which is disposed on either one of the inner tray or the inner lid in surrounding relation to the cosmetic accommodating region, and which projects toward the other component on which the hermetically sealing ring is disposed. At the same time the hermetically sealing ring is frictionally contacting and sliding against the annular ridge. Therefore, even if there are cosmetic-material-deposits on the annular ridge and the hermetically sealing ring, those cosmetic-material-deposits can be scraped off by the sliding movement of the annular ridge and the hermetically sealing ring. Therefore, when the inner lid is completely closed, the clean annular ridge is pressed against the hermetically sealing ring which is clean and free of cosmetic-material-deposits, providing an excellent hermetically sealing capability.

The surface of the hermetically sealing ring against which the annular ridge slides is formed into a slanted surface. Consequently, as the inner lid is progressively closed, the annular ridge slides progressively and more strongly against the slanted surface of the hermetically sealing ring for effectively scraping off cosmetic-material-deposits. When the inner lid is fully closed, the pressing force between the hermetically sealing ring and the annular ridge is increased for a better hermetically sealing capability.

Because the hermetic sealing mechanism is disposed around the cosmetic accommodating region, it is not necessary to provide a large annular recess around the cosmetic accommodating region as in the conventional arrangements. Therefore, the open area of the cosmetic accommodating region may be made larger, increasing the amount of the accommodated cosmetic material without increasing the size of the cosmetic container.

According to the present invention, furthermore, when the single operating member of the push-piece is operated while both the outer lid and the inner lid are closed, the push-piece is rotated, causing the first releasing member to release the first hook and the first engaging tooth out of engagement, and also causing the second releasing member to release the second hook and the second engaging tooth out of engagement. Therefore, both the outer lid and the inner lid can be opened with the single push-piece. Because the outer lid and the inner lid can be opened together by a single action of the push-piece, the lids of a double structure can be opened in a highly simple operation. Since the push-piece is rotatable, the space for the push-piece to operate may be small, resulting in reduction in the size of the cosmetic container.

According to the present invention, furthermore, the lock mechanism is disposed between the inner tray of the refill case and the pair of side walls of the container housing in a disengageably engageable manner for locking the refill case installed in one side of the accommodating space against sliding movement, thereby preventing the refill case from freely moving in the accommodating space when the container housing is tilted.

According to the present invention, furthermore, the pair of slide guides and the pair of slides are vertically disengageably engageable with each other for installing the refill case into and removing the refill case from the accommodating space of the container housing in the vertical directions. Consequently, there are excellent effects such as that the refill case can be installed and removed vertically in two ways.

What is claimed is:

1. A hermetically sealed cosmetic container comprising:

a container housing having a bottom wall and an outer peripheral wall surrounding said bottom wall, said outer peripheral wall and said bottom wall defining an accommodating space therein;

an outer lid rotatably mounted on said container housing for opening and closing said accommodating space;

a refill case having an inner tray defining a cosmetic accommodating region for accommodating cosmetic material therein, an inner lid for opening and closing said cosmetic accommodating region, a hinge mechanism projecting outwardly from said inner tray for rotatably mounting said inner lid to said inner tray, and a hermetic sealing mechanism disposed between said inner tray and said inner lid for surrounding and hermetically sealing said cosmetic accommodating region, said refill case being detachably installed in one side of said cosmetic accommodating region, leaving a space in the other side of said cosmetic accommodating region, with said hinge mechanism being disposed adjacent to said outer peripheral wall of said container housing, and said inner lid having an openable and closable end positioned on the opposite side of said hinge mechanism and within said accommodating space;

a groove defined in the outer peripheral wall portion of said container housing adjacent to said hinge mechanism, said hinge mechanism being fitted in said groove so as to be exposed out of said container housing;

a pair of slide guides disposed horizontally on a pair of parallel side walls of the outer peripheral wall portion of said container housing, the outer peripheral wall portion with said groove defined therein being interposed between said slide guides; and a pair of slides disposed in said inner tray of said refill case for disengageably engaging with said pair of slide guides, respectively, being guided by said slide guides to slide said refill case horizontally from one side of said accommodating space to the other;

said hermetic sealing mechanism comprising:

an annular ridge disposed on either one of said inner tray or said inner lid in surrounding relationship to said cosmetic accommodating region, and projecting toward the other; and a hermetically sealing ring disposed on the other of said inner tray and said inner lid and having a slanted surface movable in frictional contact with said annular ridge while said inner lid is being closed, said hermetically sealing ring being hermetically pressable against the entire periphery of said annular ridge.

2. A hermetically sealed cosmetic container according to claim 1, further comprising a lid opening mechanism including:

a first engaging tooth disposed on said container housing;

a first hook disposed on said outer lid for disengageably engaging said first engaging tooth to keep said outer lid closed;

a second engaging tooth disposed on said inner tray of said refill case;

a second hook disposed on said inner lid of said refill tray for disengageably engaging said second engaging tooth to keep said inner lid closed; and a single push-piece rotatably mounted on said container housing for releasing said first hook and said first engaging tooth out of engagement and also releasing said second hook and the second engaging tooth out of engagement;

said push-piece comprising:

a single operating member for imparting operating forces to rotate said push-piece; and a first releasing member for releasing said first hook from said first engaging tooth and a second releasing member for releasing said second hook from said second engaging tooth, under the operating forces imparted to said operating member.

3. A hermetically sealed cosmetic container according to claim 1, further comprising a lock mechanism disposed between said inner tray of said refill case and said pair of side walls of said container housing and being disengageably engaged for locking said refill case installed in one side of the accommodating space against sliding movement.

4. A hermetically sealed cosmetic container according to claim 1, wherein said pair of slide guides and said pair of slides are vertically disengageably engageable with each other for installing said refill case into and removing said refill case from said accommodating space in said container housing in the vertical directions.

5. A hermetically sealed cosmetic container comprising:

a container housing having a bottom wall and an outer peripheral wall surrounding said bottom wall, said outer peripheral wall and said bottom wall defining an accommodating space therein;

an outer lid rotatably mounted on said container housing for opening and closing said accommodating space;

a refill case having an inner tray defining a cosmetic accommodating region for accommodating cosmetic material therein, an inner lid for opening and closing said cosmetic accommodating region, a hinge mechanism projecting outwardly from said inner tray for rotatably mounting said inner lid to said inner tray, and a hermetic sealing mechanism disposed between said inner tray and said inner lid for surrounding and hermetically sealing said cosmetic accommodating region, said refill case being detachably installed in one side of said cosmetic accommodating region, leaving a space in the other side of said cosmetic accommodating region, with said hinge mechanism being disposed adjacent to said outer peripheral wall of said container housing, and said inner lid having an openable and closable end positioned on the opposite side of said hinge mechanism and within said accommodating space;

a groove defined in the outer peripheral wall portion of said container housing adjacent to said hinge mechanism, said hinge mechanism being fitted in said groove so as to be exposed out of said container housing;

a pair of slide guides disposed horizontally on a pair of parallel side walls of the outer peripheral wall portion of said container housing, the outer peripheral wall portion with said groove defined therein being interposed between said slide guides; and a pair of slides disposed in said inner tray of said refill case for disengageably engaging with said pair of slide guides, respectively, being guided by said slide guides to slide said refill case horizontally from one side of said accommodating space to the other;

a lock mechanism disposed between said inner tray of said refill case and said pair of side walls of said container housing and being disengageably engaged for locking said refill case installed in one side of the accommodating space against sliding movement; and a lid opening mechanism including: a first engaging tooth disposed on said container housing; a first hook disposed on said outer lid for disengageably engaging said first engaging tooth to keep said outer lid closed; a second engaging tooth disposed on said inner tray of said refill case; a second hook disposed on said inner lid of said refill tray for disengageably engaging said second engaging tooth to keep said inner lid closed; and a single push-piece rotatably mounted on said container housing for releasing said first hook and said first engaging tooth out of engagement and also releasing said second hook and the second engaging tooth out of engagement; said push-piece comprising: a single operating member for imparting operating forces to rotate said push-piece; and a first releasing member for releasing said first hook from said first engaging tooth and a second releasing member for releasing said second hook from said second engaging tooth, under the operating forces imparted to said operating member;

said hermetic sealing mechanism comprising:

an annular ridge disposed on either one of said inner tray or said inner lid in surrounding relationship to said cosmetic accommodating region, and projecting toward the other; and a hermetically sealing ring disposed on the other of said inner tray and said inner lid and having a slanted surface movable in frictional contact with said annular ridge while said inner lid is being closed, said hermetically sealing ring being hermetically pressable against the entire periphery of said annular ridge.

* * * * *